US010962289B2

(12) United States Patent
Shin et al.

(10) Patent No.: US 10,962,289 B2
(45) Date of Patent: Mar. 30, 2021

(54) HIGH-VACUUM SERIAL CONDENSER SYSTEM

(71) Applicant: LG CHEM, LTD., Seoul (KR)

(72) Inventors: Dae-Young Shin, Daejeon (KR); Eun-Jung Joo, Daejeon (KR); Joon-Ho Shin, Daejeon (KR)

(73) Assignee: LG CHEM LTD., Seoul (KR)

( * ) Notice: Subject to any disclaimer, the term of this patent is extended or adjusted under 35 U.S.C. 154(b) by 0 days.

(21) Appl. No.: 15/533,596

(22) PCT Filed: Nov. 8, 2016

(86) PCT No.: PCT/KR2016/012818
§ 371 (c)(1),
(2) Date: Jun. 6, 2017

(87) PCT Pub. No.: WO2017/086648
PCT Pub. Date: May 26, 2017

(65) Prior Publication Data

US 2017/0370649 A1 Dec. 28, 2017

(30) Foreign Application Priority Data

Nov. 19, 2015 (KR) ..... 10-2015-0162632

(51) Int. Cl.

| | |
|---|---|
| ***F28B 7/00*** | (2006.01) |
| ***F25B 39/04*** | (2006.01) |
| ***F25B 41/00*** | (2021.01) |
| ***F28B 1/02*** | (2006.01) |
| ***F28B 9/02*** | (2006.01) |

(52) U.S. Cl.
CPC ..... *F28B 7/00* (2013.01); *F25B 39/04* (2013.01); *F25B 41/00* (2013.01); *F28B 1/02* (2013.01); *F28B 9/02* (2013.01)

(58) Field of Classification Search
CPC ..... F28F 7/00; F28F 1/02; F28F 9/02; F25B 39/04; F25B 6/00; F25B 6/02; F25B 41/00; F28B 7/00; F28B 1/02; F28B 9/02
See application file for complete search history.

(56) References Cited

U.S. PATENT DOCUMENTS

| | | | | |
|---|---|---|---|---|
| 3,013,404 A * | 12/1961 | Endress | ..... | F25B 43/043 62/195 |
| 3,230,729 A * | 1/1966 | Eber | ..... | F25B 43/043 62/195 |
| 4,551,181 A * | 11/1985 | Stearman | ..... | F28G 9/00 134/22.11 |
| 5,714,553 A | 2/1998 | Kim et al. | | |
| 6,596,129 B1 | 7/2003 | Yoneda et al. | | |
| 6,868,695 B1 | 3/2005 | Dingel et al. | | |

(Continued)

FOREIGN PATENT DOCUMENTS

| | | |
|---|---|---|
| CN | 1210246 C | 7/2005 |
| CN | 103185362 A | 7/2013 |

(Continued)

*Primary Examiner* — Travis C Ruby
*Assistant Examiner* — Harry E Arant
(74) *Attorney, Agent, or Firm* — Dentons US LLP

(57) ABSTRACT

The present invention relates to a high-vacuum serial condenser system that can minimize a pressure drop of fluid in condensers by disposing straight pipes between the condensers and installing baffles at predetermined angles in the condensers.

5 Claims, 4 Drawing Sheets

(56) References Cited

U.S. PATENT DOCUMENTS

| | | | | |
|---|---|---|---|---|
| 2004/0103637 | A1 | 6/2004 | Maisotsenko et al. | |
| 2005/0056029 | A1 | 3/2005 | Maisotsenko et al. | |
| 2009/0000775 | A1 | 1/2009 | Al-Hadhrami | |
| 2009/0158762 | A1* | 6/2009 | Eber | F25B 39/04 62/196.4 |
| 2009/0301699 | A1 | 12/2009 | Karrs et al. | |
| 2010/0319879 | A1* | 12/2010 | Sugitani | F01K 9/00 165/104.21 |

FOREIGN PATENT DOCUMENTS

| | | | | | |
|---|---|---|---|---|---|
| EP | 1097742 | A1 | | 5/2001 | |
| GB | 652680 | A | * | 5/1951 | F25B 1/053 |
| JP | 08189728 | A | | 7/1996 | |
| JP | 09176298 | A | | 7/1997 | |
| JP | 2000329368 | A | | 11/2000 | |
| KR | 20-1998-0028552 | U | | 8/1998 | |
| KR | 10-0444331 | B1 | | 8/2004 | |
| KR | 10-1256733 | B1 | | 5/2013 | |

* cited by examiner

HIGH-VACUUM SERIAL CONDENSER SYSTEM

TECHNICAL FIELD

This application is a National Stage Application of International Application No. PCT/KR2016/012818 filed on Nov. 8, 2016, which claims the benefit of Korean Patent Application No. 10-2015-0162632 filed on Nov. 19, 2015, all of which are hereby incorporated by reference in their entirety for all purposes as if fully set forth herein.

The present invention relates to a high-vacuum serial condenser system and, more particularly, to a high-vacuum serial condenser system that can minimize a pressure drop of fluid in condensers by disposing straight pipes between the condensers and installing baffles at predetermined angles in the condensers.

BACKGROUND ART

In general, condensers (heat exchangers) are, depending on the types, classified into an air-cooled condenser, a water-cooled condenser, an evaporative condenser, a shell and tube condenser, etc., and of theses condensers, the shell and tube condenser is easiest to manufacture and operate, so it is generally used in various commercial processes. The shell and tube condenser can be categorized into various types, depending on the shell types based on standard types by TEMA (Tubular Exchanger Manufacturers Association). Of these shell types, E-type is most widely used, and a J-type or an X-type is used for a large pressure drop.

FIG. 1 is a view showing a process of condensing in a common X-type serial condenser system. In the shell and tube condenser system, when the heat exchange area is insufficient or two or more refrigerants (cooling water and chilled water) are used, two or more condensers are connected in series, as shown in FIG. 1. However, as can be seen from FIG. 1, the passage for delivering vapor from a first condenser 2 to a second condenser 4 is bent at several locations (that is, with four elbows indicated by red dotted circles in FIG. 1), which causes a pressure drop. Accordingly, when installing high-vacuum condensers in series, it is most important to minimize a pressure drop of fluid that is supplied to the condensers.

DISCLOSURE

Technical Problem

As described above, when two or more condensers are connected in series, a pressure drop is usually generated, so a way of condensing fluid at shell sides of condensers is required. An X-type of shell is used to solve this problem, but even in this case, a pressure drop over at least several torrs is generated and it is difficult to design high-vacuum condensers of about 3 to 30 torr.

Therefore, an object of the present invention is to provide a high-vacuum serial condenser system that can minimize a pressure drop of fluid in condensers by disposing straight pipes between the condensers and installing baffles at predetermined angles in the condensers.

Technical Solution

In order to achieve the object of the present invention, a high-vacuum serial condenser system includes: a first condenser including a shell that has one or more vapor inlets for supplying gas-state fluid to be condensed, a condensed liquid outlet for discharging condensed liquid to the outside, and one or more vapor outlets for discharging gas-state fluid, vapor supply pipes coupled to the vapor inlets, and a condensed liquid discharge pipe coupled to the condensed liquid outlet; a second condenser including a shell that has vapor inlets for supplying gas-state fluid discharged from the vapor outlets to be condensed, a condensed liquid outlet for discharging condensed liquid to the outside, and a vapor outlet for discharging the gas-state fluid to the outside, a condensed liquid discharge pipe coupled to the condensed liquid, and a vapor discharge pipe coupled to the vapor outlet; and vapor delivery pipes for delivering and supplying the gas-state fluid discharged from the vapor outlets of the first condenser to the second condenser, in which vapor outlets of the first condenser and the vapor inlets of the second condenser face each other, and tubes for delivering refrigerants and baffles for making flow of fluid having a specific pattern are disposed in each of the first and second condensers.

Advantageous Effects

According to the high-vacuum serial condenser system of the present invention, it is possible to minimize the length by providing straight pipes between the condensers and it is also possible to minimize a pressure drop of fluid in the condensers by arranging baffles at a predetermined angle in the condensers.

BEST MODE

Hereinafter, the present invention will be described in detail with reference to the accompanying drawings.

Figure 1:
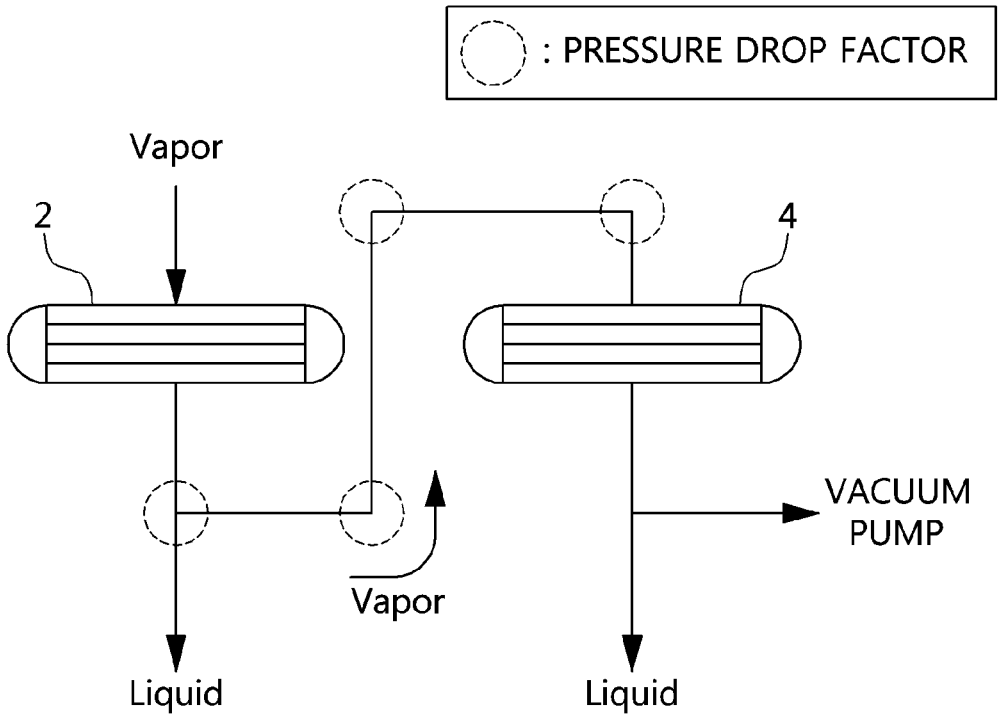
FIG. 1 is a schematic view of a common X-type serial condenser system.
Figure 2:
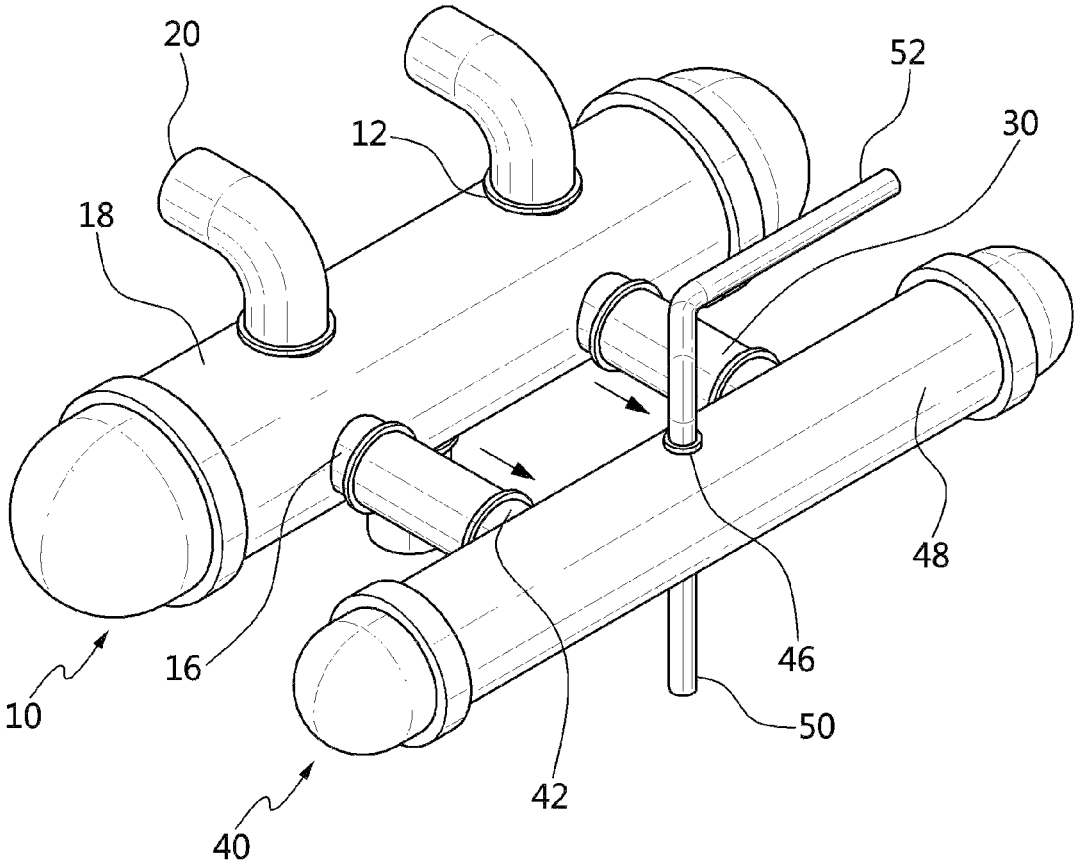
FIG. 2 is a perspective view of a high-vacuum serial condenser system according to an embodiment of the present invention.
Figure 3:
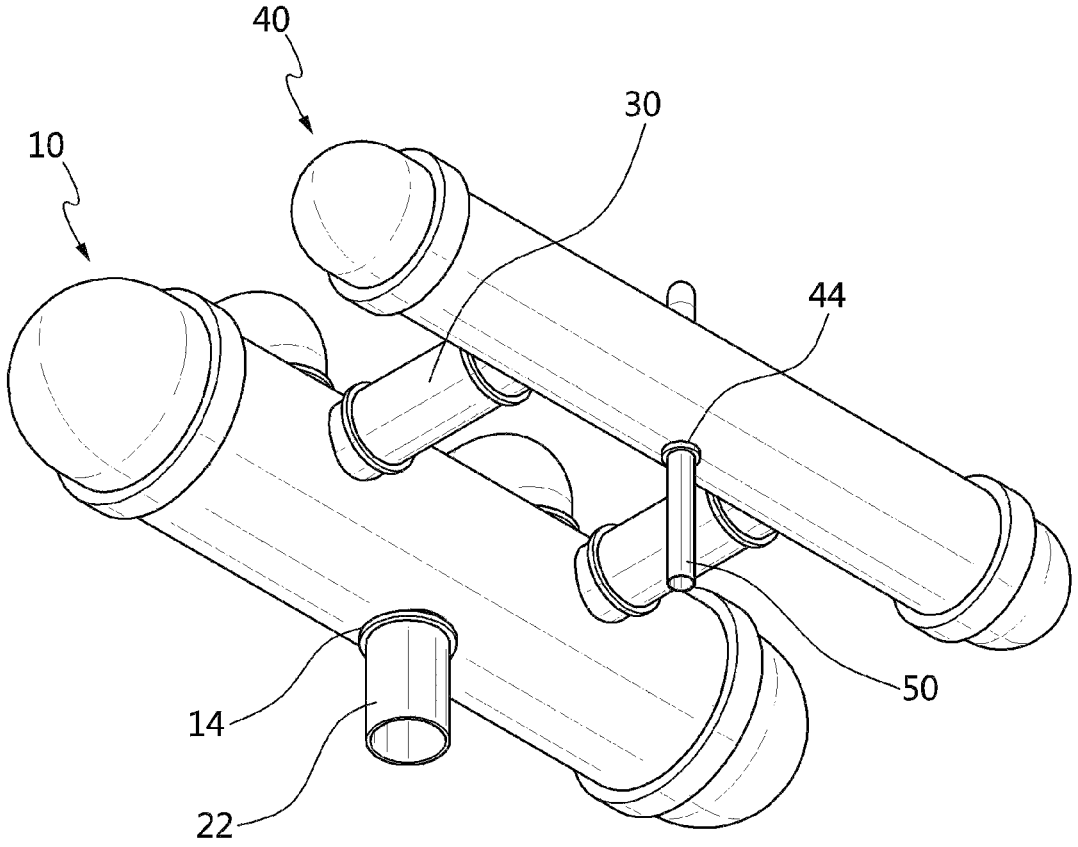
FIG. 3 is a perspective view of the bottom of the high-vacuum serial condenser system according to an embodiment of the present invention.

FIG. 2 is a perspective view of a high-vacuum serial condenser system according to an embodiment of the present invention and FIG. 3 is a perspective view of the bottom of the high-vacuum serial condenser system according to an embodiment of the present invention. Referring to FIGS. 2 and 3, a high-vacuum serial condenser system according to the present invention includes: a first condenser 10 that includes a shell 18 that has one or more vapor inlets 12 for supplying gas-state fluid to be condensed, a condensed liquid outlet 14 for discharging condensed liquid to the outside, and one or more vapor outlets 16 for discharging gas-state fluid, vapor supply pipes 20 coupled to the vapor inlets 12, and a condensed liquid discharge pipe 22 coupled to the condensed liquid outlet 14; a second condenser 40 that includes a shell 48 that has vapor inlets 42 for supplying gas-state fluid discharged from the vapor outlets to be condensed, a condensed liquid outlet 44 for discharging condensed liquid to the outside, and a vapor outlet 46 for discharging the gas-state fluid to the outside, a condensed liquid discharge pipe 50 coupled to the condensed liquid 44, and a vapor discharge pipe 52 coupled to the vapor outlet 46; and vapor delivery pipes 30 for delivering and supplying the gas-state fluid discharged from the vapor outlets 16 of the first condenser 10 to the second condenser 40.

The vapor outlets 16 of the first condenser 10 and the vapor inlets 42 of the second condenser face each other, and tubes (not shown) for delivering refrigerants (cooling water and chilled water) and baffles (not shown) for making flow of fluid having a specific pattern are disposed in each of the first and second condensers 10 and 40.

The high-vacuum serial condenser system according to the present invention uses condensers having about 3 to 30 torr with little pressure drop of fluid, and various shell types of condensers such as an E-shell type, an I-shell type, a J-shell type, and an X-shell type of shell types by TEMA (Tubular Exchanger Manufacturers Association) may be used, but the X-shell type condenser that can minimize a pressure drop is preferable. Meanwhile, the others except for the components for minimizing a pressure drop of fluid in pipes between condensers that is an object of the present invention, that is the components and operation mechanisms of common serial condenser systems are briefly or not described herein. For example, in the high-vacuum serial condenser system according to the present invention, in order to supply and discharge cooling water, a cooling water inlet (not shown) and a cooling water outlet (not shown) are formed respectively at the head and the rear of each of the first condenser 10 and the second condenser 40, and a cooling water inlet pipe (not shown) and a cooling water discharge pipe (not shown) can be coupled respectively to the cooling water inlet and outlet. Accordingly, it should be noted that even if not specifically stated herein, the basic components of common condenser systems are included in the high-vacuum serial condenser system according to the present invention.

The high-vacuum serial condenser system according to the present invention is characterized in that the vapor inlets 12 and the vapor outlet 16 are arranged at 90° in the first condenser 10, the vapor inlets 42 and the vapor outlet 46 are arranged at 90° in the second condenser 40 (that is, the vapor outlets 16 and the vapor inlets 42 are formed at the sides facing each other of the first condenser 10 and the second condenser 40), and the pipes (the vapor delivery pipes 30 herein) connecting the first condenser 10 and the second condenser 40 are made straight, so it is possible to prevent or minimize a pressure drop that is generated in pipes between two serial condensers in the related art. Further, since the pipes connecting the first condenser 10 and the second condenser 40 are made straight, the two condensers 10 and 40 can be arranged in parallel with each other, as shown in FIGS. 2 and 3, so it is possible to more efficiently use the space where the condensers are installed.

That is, by using the high-vacuum serial condenser system according to the present invention, it is possible to solve the problem with existing serial condenser systems in the related art. That is, it is possible to prevent or minimize a pressure drop that is generated in proportion to the lengths of pipes between condensers when the condensers (heat exchangers) are connected in series, particularly, a large pressure drop at elbows where pipes connecting condensers are bent at the right angle (90 degrees). When pressure decreases, vaporization occurs well, so condensation becomes difficult, and in this case, the environment is contaminated and the costs for operation and raw materials are increased due to vapor that is discharged without condensing. Accordingly, by using the high-vacuum serial condenser system according to the present invention in a condensing process within an operation pressure range (or a fluid pressure range) of about 3 to 30 torr, a pressure drop of fluid is minimized, so the problems described above can be solved.

The number of the vapor inlets 12 of the first condenser 10 may depend on the length of the condenser, but it is preferable to form one vapor inlet 12 per 1 to 2 m of the length of the condenser. The number of the vapor outlets 16 of the first condenser 10, similar to the vapor inlets 12 of the first condenser 10, may depend on the length of the condenser and it is preferable to form one vapor inlet per about 1 to 2 m of the length of the condenser. The reason of forming one vapor inlet 12 and one vapor outlet 16 per about 1 to 2 m of the length of the condenser is that a pressure drop may increase when the numbers of the vapor inlets 12 and the vapor outlets 16 are small. Further, when the number of the vapor inlets 12 is small, vapor may not be smoothly distributed (or dissipated) in the shell 18 or the condensing efficiency may be decreased due to channeling. A distributor is disposed in the shell for smooth distribution of vapor in a shell, but it is also a factor that causes a pressure drop, so it cannot be used in high-vacuum condensers. On the contrary, when the number of the vapor inlets 12 is large, a pressure drop is decreased and vapor is smoothly distributed in the shell, but the manufacturing cost (for the vapor inlets and pipes to be connected to the vapor inlets) increases, so it is preferable to set an appropriate numbers of vapor inlets and vapor outlets.

Further, the opposite ends of the vapor delivery pipes 30 are supposed to be coupled to the vapor outlets 16 of the first condenser 10 and the vapor inlets 42 of the second condenser 40, so the number of the vapor inlets 42 of the second condenser 40 should be the same as the number of the vapor outlets 16 of the first condenser 10. On the other hand, as shown in FIG. 2, the arrows shown at sides of the vapor delivery pipes 30 indicate the flow direction of vapor from the first condenser 10 to the second condenser 40.

Figure 4:
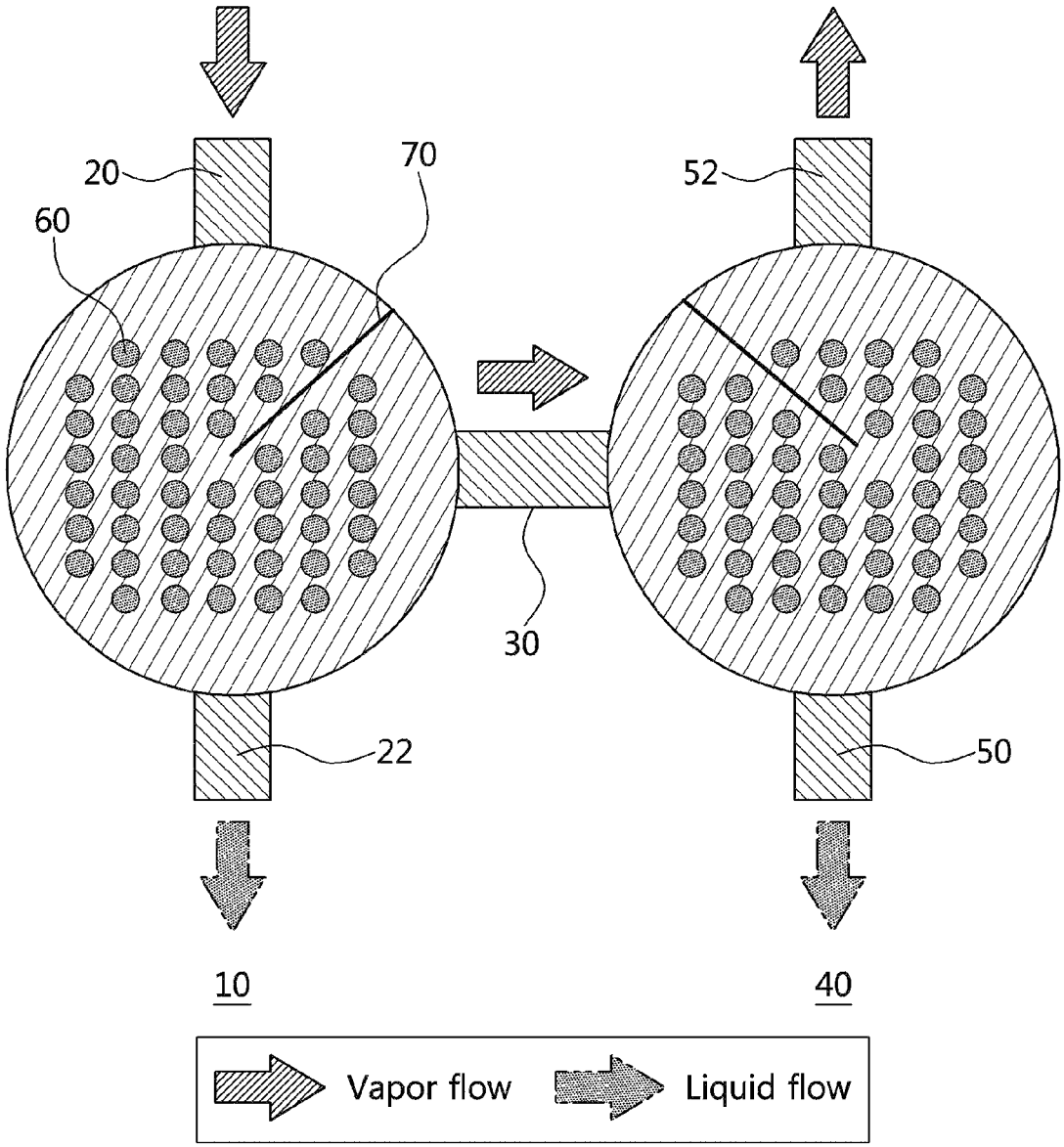
FIG. 4 is a vertical cross-sectional views showing arrangement of baffles in condensers of the high-vacuum serial condenser system of the present invention.

The high-vacuum serial condenser system according to the present invention is further characterized in that baffles for making a specific pattern of fluid flow in the condensers are disposed at 45° between the vapor inlets 12 and the vapor outlets 16 of the first condenser 10 and between the vapor inlets 42 and the vapor outlets 46 of the second condenser 40 in order to prevent a decrease in condensing efficiency that is generated when the gas-state fluid supplied into the condensers 10 and 40 through the vapor inlets 12 and 42 is discharged directly outside through the vapor outlets 16 and 46 without condensing. FIG. 4 is a cross-sectional views showing arrangement of baffles in the condenser of the high-vacuum serial condenser system according to the present invention, in which the hatched arrows indicate the flow of vapor and the other arrows at the lower part indicate the flow of condensed liquid discharged out of the condensers. That is, there are no baffles in the existing X-shell type condensers, so vapor flowing inside through vapor inlets at the top of the condensers condenses while flowing down in the condenser shells and non-condensed vapor is discharged with condensed liquid through outlets at the bottom of the condensers. However, according to the present invention, as shown in FIG. 4, baffles 70 are arranged at 45° among cooling water tubes (or refrigerant tubes) 60, so the fluid supplied through the vapor inlets 12 and 42 of the first condenser 10 and the second condenser 40 is blocked and flows opposite to the vapor outlets 16 and 46, thus the maximal amount of fluid is condensed. Therefore, the amount of fluid that is discharged directly to the vapor deliver pipes 30 without condensing can be reduced and accordingly, the condensing efficiency in the first condenser 10 and the second condenser 40 can be maximized.

Mode for Invention

Preferable embodiments are provided hereafter to help understand the present invention, but it is apparent to those skilled in the art that the following embodiments are just examples and may be changed and modified in various ways without the spirit and scope of the present invention and the changes and modifications are also included in claims.

Embodiment 1

High-Vacuum Serial Condenser System

The system includes X-shell type condensers, and in which, as shown in FIGS. 2 and 3, vapor outlets of a first condenser were formed at a side of the first condenser and connected to vapor inlets at a side of a second condenser through straight vapor delivery pipes having a length of 1.5 m, and condensed liquid outlets were formed at the bottoms of the first and second condensers. Styrene that is a raw material was supplied to the first condenser at a flow rate of 3 ton/hr at 150□ and 10 torr and vapor discharged from the first condenser was supplied to the second condenser at a flow rate of 3 ton/hr at 40□ and 9.93 torr.

Comparative Example 1

Common X-Type Serial Condenser System

Vapor outlets of a first condenser and vapor inlets of a second condenser were all formed at the bottoms of the first and second condensers, respectively, and were connected through vapor delivery pipes bent as four positions (that is, composed of 1 m, 1 m, 3 m, 1 m, and 3 m parts), vapor discharged from the first condenser was supplied to the second condenser at 7.74 torr, and other conditions were the same as in Embodiment 1.

Embodiment 1 and Comparative Example 1

Evaluation of Pressure Drop in Condenser

The condensers used in Embodiment 1 and Comparative example 1 are all X-shell types and there is little difference in pressure drop in the condensers by the positions of the vapor inlets and the vapor outlets. Accordingly, as the result of comparing the pressure drops only in the vapor delivery pipes in Embodiment 1 and Comparative example 1, a pressure drop of 0.7% was generated in the vapor delivery pipes in Embodiment 1, while a pressure drop of 22% was generated in the vapor delivery pipes (the total 7 m pipes bent at four positions) in Comparative example 1. Accordingly, it can be seen that it is required to increase the power of a vacuum pump to obtain pressure at the initially set level, so it is only required to suck the vapor at 9.93 torr using a vacuum pump in Embodiment 1 and to suck the vapor at 7.74 torr using a vacuum pump in Comparative example 1 in order to maintain pressure at 10 torr. Further, it can be seen that the pressure in the second condenser drops by 22.6%, as compared with the first condenser, in Comparative example 1, so the condensing efficiency considerably decreases, as compared with the first condenser, and the operation cost increases, as compared with Embodiment 1.

<Description of the Reference Numerals in the Drawings>

| | |
|---|---|
| 10: First condenser | 12: Vapor inlet of first condenser |
| 14: Condensed liquid outlet of first condenser | 16: Vapor outlet of first condenser |
| 18: Shell of first condenser | 20: Vapor inlet pipe |
| 22: Condensed liquid discharge pipe of first condenser | 42: Vapor inlet of second condenser |
| 30: Vapor delivery pipe | 50: Condensed liquid discharge pipe of second condenser |
| 40: Second condenser | 70: Baffle |
| 44: Condensed liquid outlet of second condenser | |
| 46: Vapor outlet of second condenser | |
| 48: Shell of second condenser | |
| 52: Vapor discharge pipe | |
| 60: Cooling water tube | |

The invention claimed is:

1. A high-vacuum serial condenser system comprising:

a first condenser including a shell that has one or more vapor inlets for supplying gas-state fluid to be condensed, a condensed liquid outlet for discharging condensed liquid to the outside, and one or more vapor outlets for discharging gas-state fluid, vapor supply pipes coupled to the one or more vapor inlets, and a condensed liquid discharge pipe coupled to the condensed liquid outlet;

a second condenser including a shell that has one or more vapor inlets for supplying gas-state fluid discharged from the one or more vapor outlets of the first condenser to be condensed, a condensed liquid outlet for discharging condensed liquid to the outside, and a vapor outlet for discharging the gas-state fluid to the outside, a condensed liquid discharge pipe coupled to the condensed liquid outlet, and a vapor discharge pipe coupled to the vapor outlet; and vapor delivery pipes for delivering and supplying the gas-state fluid discharged from the one or more vapor outlets of the first condenser to the second condenser, wherein the one or more vapor outlets of the first condenser and the one or more vapor inlets of the second condenser face each other; the vapor inlets and the vapor outlets of the first condenser are arranged at a right angle relative to a longitudinal center axis of the first condenser, and the vapor inlets and the vapor outlets of the second condenser are arranged at a right angle relative to a longitudinal center axis of the second condenser; and tubes for delivering refrigerants and baffles for making flow in a specific pattern are disposed in each of the first and second condensers at 45° between the one or more vapor inlets of the first condenser and the one or more vapor outlets of the first condenser and at 45° between the one or more vapor inlets of the second condenser and the vapor outlet of the second condenser, wherein the vapor delivery pipes between the one or more vapor outlets of the first condenser and the one or more vapor inlets of the second condenser are straight pipes, and wherein pressure of the fluid in the condensers is 3 to 30 torr.

2. The system of claim 1, wherein the baffles are arranged at 45° to block the fluid supplied through the one or more vapor inlets of the first condenser and the second condenser so that the fluid flows opposite to the vapor outlets.

3. The system of claim 1, wherein the first condenser includes two or more vapor inlets, and each of the vapor inlets of the first condenser is formed per 1 to 2 m of a length of the first condenser.

4. The system of claim 1, wherein the first condenser includes two or more vapor outlets, and each of the vapor outlets of the first condenser is formed per 1 to 2 m of a length of the first condenser.

5. The system of claim 1, wherein the first condenser and the second condenser are cross flow condensers.

* * * * *